US008658023B2

(12) United States Patent
Coleman

(10) Patent No.: US 8,658,023 B2
(45) **Date of Patent: *Feb. 25, 2014**

(54) PROCESS FOR CRACKING HEAVY HYDROCARBON FEED

(75) Inventor: Steven T. Coleman, Humble, TX (US)

(73) Assignee: Equistar Chemicals, LP, Houston, TX (US)

( * ) Notice: Subject to any disclaimer, the term of this patent is extended or adjusted under 35 U.S.C. 154(b) by 459 days.

This patent is subject to a terminal disclaimer.

(21) Appl. No.: 12/980,514

(22) Filed: Dec. 29, 2010

(65) Prior Publication Data

US 2012/0168348 A1 Jul. 5, 2012

(51) Int. Cl.

| | |
|---|---|
| ***C10G 69/04*** | (2006.01) |
| ***C10G 69/06*** | (2006.01) |
| ***C10G 55/06*** | (2006.01) |
| ***C10G 51/02*** | (2006.01) |
| ***C10G 9/36*** | (2006.01) |

(52) U.S. Cl.
USPC ..... 208/73; 208/76; 208/78; 208/130; 585/652

(58) Field of Classification Search
USPC ..... 208/49, 58, 61, 67, 68, 72, 73, 76, 78, 208/79, 80, 83, 84, 113, 130; 585/652
See application file for complete search history.

(56) References Cited

U.S. PATENT DOCUMENTS

| | | | | |
|---|---|---|---|---|
| 3,487,006 | A | | 12/1969 | Newman et al. |
| 3,549,515 | A | | 12/1970 | Brainard et al. |
| 3,617,493 | A | | 11/1971 | Wirth et al. |
| 3,617,495 | A | * | 11/1971 | Zimmerman et al. ..... 208/80 |
| 3,839,484 | A | | 10/1974 | Zimmerman et al. |
| 3,862,898 | A | * | 1/1975 | Boyd et al. ..... 208/73 |
| 3,898,299 | A | | 8/1975 | Jones |
| 4,302,323 | A | * | 11/1981 | Chen ..... 208/89 |
| 4,310,439 | A | | 1/1982 | Langer |
| 4,615,795 | A | * | 10/1986 | Woebcke et al. ..... 208/72 |
| 4,661,241 | A | * | 4/1987 | Dabkowski et al. ..... 208/131 |
| 4,923,594 | A | | 5/1990 | Pellet et al. |
| 5,190,634 | A | * | 3/1993 | Fernandez-Baujin et al. ..... 208/107 |
| 5,506,365 | A | | 4/1996 | Mauleon et al. |
| 5,580,443 | A | * | 12/1996 | Yoshida et al. ..... 208/130 |

(Continued)

OTHER PUBLICATIONS

Mohan S. Rana, Vicente Samano, Jorge Ancheyta, J.A.I. Diaz, A review of recent advances on process technologies for upgrading of heavy oils and residua, Jun. 2007, Fuel, vol. 86, Issue 9, pp. 1216-1231.*

(Continued)

*Primary Examiner* — Nina Bhat
*Assistant Examiner* — Jonathan Miller

(57) ABSTRACT

A hydrocarbon feed is passed to a first zone of a vaporization unit to separate a first vapor stream and a first liquid stream. The first liquid stream is passed to a second zone of the vaporization unit and contacted with a counter-current steam to produce a second vapor stream and a second liquid stream. The first vapor stream and the second vapor stream are cracked in the radiant section of the steam cracker to produce a cracked effluent. The second liquid stream is catalytically cracked to produce a cracked product. The cracked product is distilled to produce an overhead stream, a light cycle oil, and a heavy cycle oil. The light cycle oil is reacted with hydrogen in the presence of a catalyst to produce a hydrotreated light cycle oil. The hydrotreated light cycle oil and the overhead stream are fed to the vaporization unit.

12 Claims, 1 Drawing Sheet

(56) References Cited

U.S. PATENT DOCUMENTS

| | | | | |
|---|---|---|---|---|
| 6,179,995 | B1 | 1/2001 | Cash et al. | |
| 6,656,346 | B2 | 12/2003 | Ino et al. | |
| 6,936,230 | B2 | 8/2005 | Zhurin et al. | |
| 7,045,669 | B2 * | 5/2006 | Sumner et al. | 585/259 |
| 7,135,602 | B1 | 11/2006 | Le Van Mao | |
| 7,138,047 | B2 | 11/2006 | Stell et al. | |
| 7,374,664 | B2 | 5/2008 | Powers | |
| 7,404,889 | B1 | 7/2008 | Powers | |
| 7,550,642 | B2 | 6/2009 | Powers | |
| 7,560,019 | B2 * | 7/2009 | McCoy et al. | 208/106 |
| 7,563,357 | B2 * | 7/2009 | Keusenkothen et al. | 208/14 |
| 2001/0042702 | A1 | 11/2001 | Stuntz et al. | |
| 2003/0150775 | A1 | 8/2003 | Stuntz et al. | |
| 2004/0122274 | A1 * | 6/2004 | Van Egmond et al. | 585/639 |
| 2005/0010075 | A1 | 1/2005 | Powers | |
| 2005/0150817 | A1 | 7/2005 | Tallman et al. | |
| 2007/0090018 | A1 | 4/2007 | Keusenkothen et al. | |
| 2007/0090019 | A1 * | 4/2007 | Keusenkothen et al. | 208/106 |
| 2007/0232845 | A1 | 10/2007 | Baumgartner et al. | |
| 2008/0116109 | A1 | 5/2008 | McCoy et al. | |
| 2008/0223754 | A1 * | 9/2008 | Subramanian et al. | 208/86 |
| 2009/0050523 | A1 | 2/2009 | Halsey | |
| 2010/0314287 | A1 * | 12/2010 | Niu et al. | 208/57 |
| 2011/0042269 | A1 * | 2/2011 | Kuechler et al. | 208/57 |
| 2011/0062054 | A1 * | 3/2011 | Gao et al. | 208/57 |

OTHER PUBLICATIONS

James G. Speight, New Approaches to Hydroprocessing, Sep. 15, 2004, Catalysis Today, vol. 98, pp. 55-60.*

Dilip Dharia, Andy Batachari, Prashant Naik, Colin Bowen, Chapter 8: Catalytic Cracking for Integration of Refinery and Steam Crackers, Nov. 2010, Advances in Fluid Catalytic Cracking: Testing Characterization, and Environmental Regulations, CRC Press, pp. 119-126.*

PCT/US2011/065771 Search Report and Written Opinion dated Dec. 21, 2012.

McCue, Richard H., "Catalytic Olefins Production," *American Institute of Chemical Engineers*, 2003 Spring National Meeting, New Orleans, LA, Mar. 21, 2003.

PCT Search Report and Written Opinion for PCT/US2011/061418 mailed Jan. 23, 2012.

PCT Search Report and Written Opinion for PCT/US2011/061654 mailed Jan. 25, 2012.

PCT Search Report and Written Opinion for PCT/US2011/061992 mailed Jan. 24, 2012.

B. E. Reynolds, E. C. Brown, M. A. Silverman, Clean Gasoline via VRDS/RFCC, Apr. 1992, Hydrocarbon Processing, vol. 71, Issue 4, pp. 43-52.

* cited by examiner

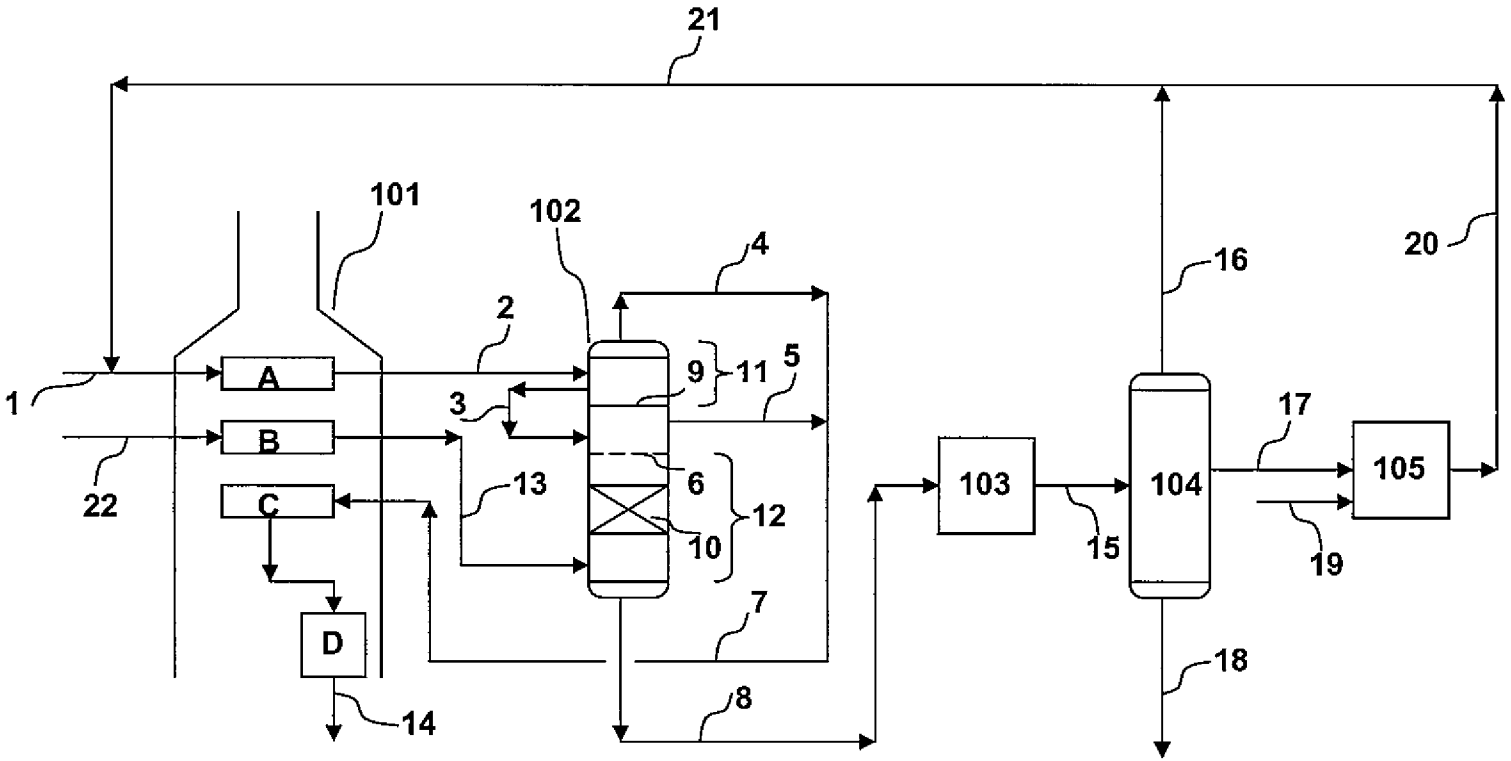
21
20
105
19
17
16
104
18
15
103
4
5
11
9
12
6
10
7
8
102
2
3
13
101
14
A
B
C
D
22
1

PROCESS FOR CRACKING HEAVY HYDROCARBON FEED

FIELD OF THE INVENTION

This invention relates to the production of olefins and other products by steam cracking of a heavy hydrocarbon feed.

BACKGROUND OF THE INVENTION

Steam cracking of hydrocarbons is a non-catalytic petrochemical process that is widely used to produce olefins such as ethylene, propylene, butenes, butadiene, and aromatics such as benzene, toluene, and xylenes. Typically, a mixture of a hydrocarbon feed such as ethane, propane, naphtha, gas oil, or other hydrocarbon fractions and steam is cracked in a steam cracker. Steam dilutes the hydrocarbon feed and reduces coking. Steam cracker is also called pyrolysis furnace, cracking furnace, cracker, or cracking heater. A steam cracker has a convection section and a radiant section. Preheating is accomplished in the convection section, while cracking reaction occurs in the radiant section. A mixture of steam and the hydrocarbon feed is typically preheated in convection tubes (coils) to a temperature of from about 900 to about 1,000° F. (about 482 to about 538° C.) in the convection section, and then passed to radiant tubes located in the radiant section. In the radiant section, hydrocarbons and the steam are quickly heated to a hydrocarbon cracking temperature in the range of from about 1,450 to about 1,550° F. (about 788 to about 843° C.). Typically the cracking reaction occurs at a pressure in the range of from about 10 to about 30 psig. Steam cracking is accomplished without the aid of any catalyst.

After cracking in the radiant section, the effluent from the steam cracker contains gaseous hydrocarbons of great variety, e.g., from one to thirty-five carbon atoms per molecule. These gaseous hydrocarbons can be saturated, monounsaturated, and polyunsaturated, and can be aliphatic, alicyclics, or aromatic. The cracked effluent also contains significant amount of molecular hydrogen. The cracked effluent is generally further processed to produce various products such as hydrogen, ethylene, propylene, mixed $C_4$ hydrocarbons, pyrolysis gasoline, and pyrolysis fuel oil.

Conventional steam cracking systems have been effective for cracking gas feeds (e.g., ethane, propane) or high-quality liquid feeds that contain mostly light volatile hydrocarbons (e.g., gas oil, naphtha). Hydrocarbon feeds containing heavy components such as crude oil or atmospheric resid cannot be cracked using a pyrolysis furnace economically, because such feeds contain high molecular weight, non-volatile, heavy components, which tend to form coke too quickly in the convection section of the pyrolysis furnace.

Efforts have been directed to develop processes to use hydrocarbon feeds containing heavy components in steam crackers due to their availability and lower costs as compared to high-quality liquid feeds. For example, U.S. Pat. No. 3,617,493 discloses an external vaporization drum for crude oil feed and a first flash to remove naphtha as a vapor and a second flash to remove volatiles with a boiling point between 450 to 1100° F. (232 to 593° C.). The vapors are cracked in a pyrolysis furnace into olefins and the separated liquids from the two flash tanks are removed, stripped with steam, and used as fuel.

U.S. Pat. No. 3,487,006 teaches a process for integrating crude fractionation facilities with the production of petrochemical products wherein light distillates are initially separated from a crude in a first fractionator. The light-distillate-free crude is mixed with steam and passed through the convection section of a pyrolysis heater and introduced into a gas oil tower. The gas oil overhead from the gas oil tower is introduced, without condensation, into the radiant heating section of the pyrolysis heater to effect the cracking thereof to desired petrochemical products. U.S. Pat. No. 3,487,006 also teaches that the residuum from the gas oil tower may be further treated, e.g., by coking, to produce lighter products.

U.S. Pat. No. 3,898,299 teaches a process for producing gaseous olefins from an atmospheric petroleum residue feedstock. The process comprises: (a) contacting the petroleum residue feedstock in a hydrogenation zone with a hydrogenation catalyst at a temperature in the range 50 to 500° C., a pressure in the range 50 to 5,000 psig, and a liquid hourly space velocity in the range 0.1 to 5.0 to effect hydrogenation of aromatic hydrocarbons; (b) separating from the resulting hydrogenated atmospheric petroleum residue feedstock a gaseous phase containing hydrogen and a liquid phase containing hydrocarbons; (c) recycling at least a portion of the gaseous phase containing hydrogen to the hydrogenation zone; (d) separating the liquid phase containing hydrocarbons into a distillate fraction having a boiling range below 650° C. and a residue fraction having a boiling range above that of the distillate fraction; (e) subjecting the distillate fraction in the presence of steam to thermal cracking in a pyrolysis zone under conditions effecting conversion of at least a portion of the liquid phase to gaseous olefins; and (f) recovering the normally gaseous olefins from the pyrolysis zone effluent.

U.S. Pat. No. 7,374,664 discloses a method for utilizing whole crude oil as a feedstock for the pyrolysis furnace of an olefin production plant. The feedstock is subjected to vaporization conditions until substantially vaporized with minimal mild cracking but leaving some remaining liquid from the feedstock, the vapors thus formed being subjected to severe cracking in the radiant section of the furnace, and the remaining liquid from the feedstock being mixed with at least one quenching oil to lower the temperature of the remaining liquid.

U.S. Pat. No. 7,404,889 discloses a method for thermally cracking a hydrocarbon feed wherein the feed is first processed in an atmospheric thermal distillation step to form a light gasoline, a naphtha fraction, a middle distillate fraction, and an atmospheric residuum. The mixture of the light gasoline and the residuum is vaporized at least in part in a vaporization step, and the vaporized product of the vaporization step is thermally cracked in the presence of steam. The naphtha fraction and middle distillate fraction are not cracked. Middle distillates typically include heating oil, jet fuel, diesel fuel, and kerosene.

U.S. Pat. No. 7,550,642 discloses a method for processing a liquid crude and/or natural gas condensate feed comprising subjecting the feed to a vaporization step to form a vaporous product and a liquid product, subjecting the vaporous product to thermal cracking, and subjecting the liquid product to crude oil refinery processing.

U.S. Pat. No. 7,138,047 teaches a process for cracking a heavy hydrocarbon feedstock containing non-volatile hydrocarbons, comprising: heating the heavy hydrocarbon feedstock, mixing the heavy hydrocarbon feedstock with a fluid and/or a primary dilution steam stream to form a mixture, flashing the mixture to form a vapor phase and a liquid phase, and varying the amount of the fluid and/or the primary dilution steam stream mixed with the heavy hydrocarbon feedstock in accordance with at least one selected operating parameter of the process, such as the temperature of the flash stream before entering the flash drum.

Processes taught by U.S. Pat. Nos. 7,404,889, 7,550,642, and 7,138,047 all have the disadvantage of generating a residual oil by-product, which has to be sold or processed elsewhere.

There remains a need to develop efficient processes that can utilize a heavy hydrocarbon feed such as a heavy crude oil to produce olefins and other petrochemical compounds in high yields.

SUMMARY OF THE INVENTION

This invention is a process for cracking a heavy hydrocarbon feed comprising a vaporization step, a catalytic cracking step, a hydrotreating step, and a steam cracking step. The heavy hydrocarbon feed is passed to a first zone of a vaporization unit to separate a first vapor stream and a first liquid stream. The first liquid stream is passed to a second zone of the vaporization unit and contacted with a counter-current steam to produce a second vapor stream and a second liquid stream. The first vapor stream and the second vapor stream are cracked in the radiant section of the steam cracker to produce a cracked effluent. The second liquid stream is catalytically cracked to produce a cracked product. The cracked product is distilled to produce a overhead stream, a light cycle oil, and a heavy cycle oil. The overhead stream may be combined with the cracked effluent and further refined into discrete petrochemical products. The light cycle oil is reacted with hydrogen in the presence of a catalyst to produce a hydrotreated light cycle oil. The hydrotreated light cycle oil is fed to the vaporization unit.

BRIEF DESCRIPTION OF THE DRAWING

FIG. 1 is a process flow diagram of one embodiment of the invention.

DETAILED DESCRIPTION OF THE INVENTION

The invention is a process for steam cracking a heavy hydrocarbon feed to produce ethylene, propylene, $C_4$ olefins, pyrolysis gasoline, and other products.

The heavy hydrocarbon feed comprises hydrocarbons with boiling points of at least 1000° F. (565° C.), defined as "heavy hydrocarbons." The heavy hydrocarbon feed may comprises one or more of gas oils, heating oils, jet fuels, diesels, kerosenes, gasolines, synthetic naphthas, raffinate reformates, Fischer-Tropsch liquids, natural gasolines, distillates, virgin naphthas, crude oils, natural-gas condensates, atmospheric pipestill bottoms, vacuum pipestill streams including bottoms, wide-boiling-range naphtha-to-gas-oil condensates, heavy non-virgin hydrocarbon streams from refineries, vacuum gas oils, heavy gas oils, atmospheric residuum, and the like.

The terms "hydrocarbon" or "hydrocarbonaceous" refers to materials that are primarily composed of hydrogen and carbon atoms, but can contain other elements such as oxygen, sulfur, nitrogen, metals, inorganic salts, and the like.

The term "whole crude oil," "crude oil," "crude petroleum," or "crude" refers to a liquid oil suitable for distillation, but which has not undergone any distillation or fractionation. Crude oil generally contains significant amount of hydrocarbons and other components that boil at or above 1,050° F. (565° C.) and non-boiling components such as asphaltenes or tar. As such, it is difficult, if not impossible, to provide a boiling range for whole crude oil.

The term "naphtha" refers to a flammable hydrocarbon mixture having a boiling range between about 30 and about 232° C., which is obtained from a petroleum or coal tar distillation. Naphtha is generally a mixture of hydrocarbon molecules having between 5 and 12 carbon atoms.

The term "light naphtha" refers to a hydrocarbon fraction having a boiling range of between 30 and 90° C. It generally contains hydrocarbon molecules having between 5 to 6 carbon atoms.

The term "heavy naphtha" refers to a hydrocarbon fraction having a boiling range of between 90 and 232° C. It generally contains hydrocarbon molecules having between 6 to 12 carbons.

The term "Fischer-Tropsch process" or "Fischer-Tropsch synthesis" refers to a catalytic process for converting a mixture of carbon monoxide and hydrogen into hydrocarbons.

The term "atmospheric resid" or "atmospheric residue" refers to a distillation bottom obtained in an atmospheric distillation of a crude oil in a refinery. The atmospheric resid obtained from an atmospheric distillation is sometimes referred to as "long resid" or "long residue." To recover more distillate product, further distillation is carried out at a reduced pressure and high temperature, referred to as "vacuum distillation." The residue from a vacuum distillation is referred to as a "short resid" or "short residue."

Steam crackers typically have rectangular fireboxes with upright tubes located between radiant refractory walls. Steam cracking of hydrocarbons is accomplished in tubular reactors. The tubes are supported from their top. Firing of the radiant section is accomplished with wall or floor mounted burners or a combination of both using gaseous or combined gaseous/liquid fuels. Fireboxes are typically under slight negative pressure, most often with upward flow of flue gas. The flue gas flows into the convection section by natural draft and/or induced draft fans, where it is cooled, typically by heat exchange with the hydrocarbon feed and/or generating or superheating steam, before exiting the heater via the stack. Radiant tubes are usually hung in a single plane down the center of the fire box. They can be nested in a single plane or placed parallel in a staggered, double-row tube arrangement. Heat transfer from the burners to the radiant tubes occurs largely by radiation, hence the term "radiant section," where the hydrocarbons are heated to a temperature of about 1,400 to about 1,550° F. (about 760 to 843° C.). Several engineering contractors including CBI Lummus Global, Shaw Stone and Webster, Kellogg Brown & Root, Linde, and KTI offer cracking furnace technologies.

The cracked effluent leaving the radiant section is rapidly cooled to prevent reactions of lighter molecules to form heavier compounds. A large amount of heat is recovered in the form of high pressure steam, which can be used in the olefin plant or elsewhere. The heat recovery is often accomplished by the use of transfer line exchangers (TLEs) that are known in the art. The cooled effluent is separated into desired products, in a recovery section of the olefin plant, by fractionation in conjunction with compression, condensation, adsorption and hydrogenation. These products include hydrogen, methane, ethylene, propylene, crude $C_4$ hydrocarbons, pyrolysis gasoline, and pyrolysis fuel oil. The term "pyrolysis gasoline" refers to a fraction having a boiling range of from about 100° F. to about 400° F. (38 to 204° C.). The term "pyrolysis fuel oil" refers to a fraction having a boiling range of from about 400° F. (204° C.) to the end point, e.g., greater than 1200° F. (649° C.).

Coke is produced as a by-product that deposits on the radiant tube interior walls, and less often in the convection tube interior walls when a gas feed or a high-quality liquid feed that contain mostly light volatile hydrocarbons is used. The coke deposited on the reactor tube walls limits the heat transfer to the tubes, increases the pressure drop across the coil, and affects the selectivity of the cracking reaction. The term "coke" refers to any high molecular weight carbonaceous solid, and includes compounds formed from the condensation of polynuclear aromatics. Periodically, the cracker has to be shut down and cleaned, which is called decoking. Typical run lengths are 25 to 100 days between decokings. Coke also deposits in transfer line exchangers.

Conventional steam crackers are effective for cracking high-quality liquid feeds, such as gas oil and naphtha. Heavy hydrocarbon feeds contain high molecular weight components (heavy hydrocarbons). These high-boiling or "non-volatile" components in the feed tend to lay down as coke in the convection section and the radiant tubes of conventional pyrolysis furnaces. Only very low levels of these non-volatile components can be tolerated in the convection section. Therefore, a heavy hydrocarbon feed containing greater than 0.5 wt % of these non-volatile components would typically be excluded from consideration as a feedstock to a conventional steam cracker. The heavy hydrocarbon feed accommodated by this invention generally contains greater than 1 wt % of these non-volatile components, preferably greater than 5 wt %, more preferably greater than 10 wt %.

The process of this invention comprises directing the heavy hydrocarbon feed, preferably after preheating in the heater convection section, to a first zone of a two zone vaporization unit. In this zone, the vapor generated in the convection section is separated from the liquid, producing the first vapor stream and the first liquid stream. The temperature in this first zone is typically 350 to 750° F. (177 to 399° C.) at about 15 to 100 psig. The first vapor stream exits the first zone and enters the radiant section of the steam cracker.

The heavy hydrocarbon feed may be preheated in the convection zone of the steam cracker to a temperature of 350 to 750° F. (177 to 399° C.) at about 15 to 100 psig before it enters the vaporization unit. Steam may be added to the heavy hydrocarbon feed before it enters the vaporization unit. Generally the first zone is maintained at a temperature of from about 350 to about 750° F. (177 to 399° C.) and a pressure of 15 to 100 psig.

The first liquid stream enters the second zone of the vaporization unit. Generally the second zone is located below the first zone. In the second zone, the first liquid is contacted with steam in a counter current fashion so that at least a portion of hydrocarbon components are vaporized. The steam, preferably at a temperature of from about 900 to about 1300° F. (482 to 704° C.) enters the second zone and provides additional thermal energy to the liquid hydrocarbons and reduces the hydrocarbon partial pressure in the second zone which promotes further vaporization of the liquid hydrocarbons. The vaporous hydrocarbons formed in the second zone (the second vapor stream) exits the vaporization unit and enter the radiant section of the steam cracker. The remaining liquid hydrocarbons (the second liquid stream) exit the second zone from the bottom of the vaporization unit. Typically, the second zone is operated at a temperature of from about 500 to about 900° F. (260 to 482° C.) and a pressure of from about 15 to about 100 psig. The weight ratio of steam fed to the second zone to the first liquid stream entering the second zone may be in the range of about 0.3:1 to about 1:1.

The second zone of the vaporization unit contains internals which promote vapor/liquid contacting, allowing the more volatile components of the liquid to transfer to the vapor phase. These internals could be fractionation trays, such as bubble cap trays, valve trays, and sieve trays, or packing, either structured or random.

According to this invention, the second liquid stream is cracked in the presence of a cracking catalyst to produce a cracked effluent. This step is called a "catalytic cracking step" or "catalytic cracking reaction." Catalytic cracking is a reaction for converting higher-boiling hydrocarbons to lower-boiling hydrocarbons (U.S. Pat. Nos. 4,923,594, 6,656,346, 6,936,230, and 7,135,602; McCue, R. H., "Catalytic Olefins Production," *American Institute of Chemical Engineers* 2003 *Spring National Meeting*, New Orleans, La., Mar. 21, 2003). The catalytic cracking reaction is conducted by contacting a hydrocarbon feedstock with a solid catalyst in the substantial absence of hydrogen at a pressure of from 70 to 300 psig and a temperature of from 850 to 1600° F. (454 to 871° C.), preferably 1000 to 1200° F. (538 to 649° C.).

The catalytic cracking reaction may be carried out in a fixed bed, moving bed, slurry, or fluidized bed operation. A fluid catalytic cracking (FCC) reaction is preferred. The fluid-bed process differs from the fixed-bed and moving-bed processes, insofar as a powdered catalyst is circulated essentially as a fluid with the feedstock. FCC uses fluidized bed of a cracking catalyst with continuous feedstock flow to cause the decomposition of hydrocarbon molecules in the presence of a FCC catalyst.

A FCC catalyst generally comprises a zeolite, an inorganic matrix, a clay, and a binder. The primary source of cracking activity comes from the zeolite. Suitable zeolites include zeolite Y, zeolite X, zeolite beta, ZSM-type zeolites, mesoporous molecular sieves, and the like.

The inorganic matrix is a porous inorganic oxide matrix component for (i) binding the components together so that the catalyst is attrition resistant enough to survive inter-particle and reactor wall collisions (i.e., attrition resistance) and (ii) to provide a degree of size selectivity with respect to molecules capable of cracking on or in the molecular sieve. The matrix itself may possess catalytic properties, generally of an acidic nature, but matrix catalytic activity is not required. Aluminas may be used as matrices.

The clay in a FCC catalyst serves as a heat sink and transfer medium. It can also serve as a sink for sodium, improving the catalyst's resistance to sodium poisoning. Clay provides little or no activity to the catalyst, but it does provide mechanical strength and density to the particle for optimum fluidization properties.

The binder is the "glue" that holds all components together and provides particle physical integrity. Some binders, such as alumina-sol polymers, have intrinsic cracking activity and thus aid in cracking.

The FCC catalyst preferably comprises a rare earth element, which is known to increase the cracking activity of the zeolite and retards crystal destruction and dealumination.

The FCC process is cyclic and includes, for example, separate zones for catalytic feedstock conversion, steam stripping, and catalyst regeneration. In the cycle, feedstock is blended with the FCC catalyst in a catalytic reactor, typically a riser reactor, for catalytic conversion into products. Lower boiling products are separated from the catalyst in a separator, e.g., a cyclone separator, and deactivated catalyst is conducted to a stripper and contacted with steam to remove entrained hydrocarbons; the latter can be combined with vapors from the cyclone separator, and both can be conducted away from the process. Stripped deactivated catalyst contains a carbonaceous residue (coke). Stripped catalyst recovered from the stripper is passed to a regenerator, e.g., a fluidized bed regenerator, and contacted with a combusting gas, e.g., air, at elevated temperature to burn off the coke and reactivate the catalyst. Regenerated catalyst is then blended with the feedstock entering the riser, completing the cycle. The catalyst regeneration step produces significant amount of energy that can be used in the process or elsewhere.

It is preferred that steam be concurrently introduced with a FCC feedstock into the FCC reactor, with the steam comprising up to about 50 wt %, preferably about 2 to about 10 wt % of the primary feed. Also, it is preferred that the feedstock's residence time in the reaction zone be less than about 20 seconds, preferably from about 0.1 to about 20 seconds, and more preferably from about 1 to about 5 seconds.

A cracked product is produced from the second liquid stream by the cracking reaction. Typically the cracked product comprises hydrocarbons ranging from hydrogen and methane to heavy hydrocarbons with boiling points in excess of 1000° F.

The cracked product is distilled to produce an overhead stream, a light cycle oil, and a heavy cycle oil. The overhead stream typically contains those hydrocarbons with a boiling points below 400° F. (204° C.). It generally contains hydrogen, methane, ethylene, ethane, propylene, propane, $C_4$ and $C_5$ hydrocarbons, and aromatic naphtha with boiling points up to 400° F. The similarity in composition between the overhead stream and lighter products from the steam cracker (e.g. boiling points up to 400° F.) allow the two product streams to be combined and further refined into finished products. This is an added benefit of combining the crude cracking and FCC technologies. The light cycle oil generally has a boiling range of from 400 to 650° F. (204 to 343° C.). The heavy cycle oil generally has a boiling range of from 650 to 1000° F. (343 to 538° C.). In addition, some heavy hydrocarbons in the FCC reactor deposit on the catalyst. This solid carbon deposit is commonly referred to as coke and is burned off the catalyst in the catalyst regenerator, an integral part of the FCC reaction system.

The light cycle oil is hydrotreated to produce a hydrotreated light cycle oil. The term "hydrotreat" refers to the saturation of a carbon-carbon double bond (e.g., in an olefin or aromatics) or a carbon-carbon triple bond and removal of heteroatoms (e.g., oxygen, sulfur, nitrogen) from heteroatomic compounds. Typical hydrotreating conditions are well known to those skilled in the art and are described in, by way of example, U.S. Pat. No. 6,179,995, the contents of which are herein incorporated by reference in their entirety. Hydrotreating conditions include a reaction temperature of between about 400° F. and about 900° F. (204 and 482° C.), preferably about 650° F. to about 850° F. (343 to 454° C.); a pressure between about 500 and about 5000 psig (34 and 340 atm), preferably about 1000 to about 3000 psig (68 to 204 atm); and a liquid hourly space velocity (LHSV) of about 0.5 $h^{-1}$ to about 20 $h^{-1}$. A suitable hydrotreating catalyst comprises a Group VI metal and a Group VIII metal supported on a porous refractory carrier such as alumina. Examples of hydrotreating catalysts are alumina supported cobalt-molybdenum, nickel-tungsten, cobalt-tungsten and nickel-molybdenum. Typically the hydrotreating catalysts are presulfided.

The hydrotreated light cycle oil is fed to the vaporization unit. Depending on the temperature of the hydrotreated light cycle oil, it may be combined with the hydrocarbon feed and further heated in the convection section of the cracker, or directly fed to the vaporization unit.

The hydrotreated light cycle oil typically has a hydrogen content of from about 13 to 15 wt %, which is about 1 to about 3 wt % higher than that of the light cycle oil prior to the treatment. The higher hydrogen content helps to improve the selectivity to lower olefins in the steam cracking, thus producing more ethylene and propylene and less fuel-grade chemicals. Hydrotreating reduces sulfur, nitrogen, and oxygen contents of the overhead hydrocarbon product. Hydrotreating can also saturate polynuclear aromatic hydrocarbons and therefore reduce coking.

The process of the invention produces a steam-cracked effluent in the radiant section of the furnace, which is processed by techniques to produce products such as hydrogen, ethylene, propylene, pyrolysis gasoline, and pyrolysis fuel oil.

FIG. 1 is a process flow diagram of one embodiment of the invention. A crude oil feed 1 is passed through a preheat zone A of the convection section of furnace 101. The crude oil feed is then passed via line 2 to vaporization unit 102, which includes an upper zone (the first zone) 11 and a lower zone (the second zone) 12. Hydrocarbon vapors that are associated with the preheated feed as received by unit 102, and additional vapors formed in zone 11, are removed from zone 11 by way of line 4 as the first vapor stream.

The hydrocarbon liquid (the first liquid stream) that is not vaporized in zone 11 moves via line 3 to the upper interior of zone 12. Zones 11 and 12 are separated from fluid communication with one another by an impermeable wall 9, which, for example, can be a solid tray. Line 3 represents external fluid down-flow communication between zones 11 and 12. If desired, zones 11 and 12 may have internal fluid communication between them by modifying wall 9 to be at least in part liquid-permeable to allow for the liquid in zone 9 to pass down into the upper interior of zone 12 and the vapor in zone 12 to pass up into the lower interior of zone 11.

By whatever way the first liquid stream moves from zone 11 to zone 12, it moves downwardly into the upper interior of zone 12, and encounters preferably at least one liquid distribution device 6. Device 6 evenly distributes liquid across the transverse cross section of unit 102 so that the downwardly flowing liquid spreads uniformly across the width of the tower before it contacts bed 10. Suitable liquid distribution devices include perforated plates, trough distributors, dual flow trays, chimney trays, spray nozzles, and the like.

Bed 10 extends across the full transverse cross section of unit 102 with no large open vertical paths or conduits through which a liquid can flow unimpeded by bed 10. Thus, the downwardly flowing liquid cannot flow from the top to the bottom of the second zone 12 without having to pass through bed 10. Preferably, bed 10 contains packing materials and/or trays for promoting intimate mixing of liquid and vapor in the second zone.

Primary dilution steam, generated by preheating a low temperature steam in line 22 by zone B, is introduced into the lower portion of zone 12 below bed 10 via line 13. The first liquid stream from the first zone 11, enters the second zone 12 via line 3, passes liquid distributor 6, moves downwardly in zone 12, and intimately mixes with the steam in bed 10. As a result, additional vapor hydrocarbons (the second vapor stream) are formed in zone 12. The newly formed vapor, along with the dilution steam, is removed from zone 12 via line 5 and combined with the vapor in line 4 to form a hydrocarbon vapor stream in line 7. The stream in line 7 contains all hydrocarbon vapors (the first vapor stream and the second vapor stream) generated in the vaporization unit from feed 1 and steam fed to the vaporization unit.

The hydrocarbon vapors and steam from the vaporization unit is passed through a preheat zone C in the convection zone of furnace 101, further heated to a higher temperature, and enters the radiant tubes in the radiant section D of furnace 101. In the radiant section D, the vaporous hydrocarbons are cracked.

The remaining liquid hydrocarbons (the second liquid stream) in zone 12 exit vaporization unit 102 from the bottom, and is heated up (not shown in FIG. 1) and fed to a catalytic cracking zone 103, where it is contacted with a cracking catalyst. The cracked product 15 is distilled in zone 104 into an overhead stream (typically containing methane, ethane, ethylene, propane, propylene, butanes, butenes, hydrogen, and an aromatic naphtha) in line 16, a light cycle oil in line 17, and a heavy cycle oil in line 18. The light cycle oil in line 17 is hydrotreated in zone 105. Hydrogen is added to hydrotreating zone 105 via line 19. The hydrotreated product in line 20 is combined with the overhead stream 16 to form stream 21 which is combined with the feed in line 1.

This invention efficiently separates a heavy hydrocarbon feed into vapor streams and the second liquid stream. The second liquid stream is further catalytically cracked into smaller hydrocarbon molecules in a catalytic cracking step. The hydrotreating of the light cycle oil, which is separated from the cracked product, removes sulfur, nitrogen, and oxygen from it, and saturates the polynuclear aromatic molecules, thus produces additional feed for the steam cracking step. The heavy cycle oil may be processed by the gasoline fractionator of the olefin plant. The process produces light olefins such as ethylene, propylene, and other useful petrochemical intermediates directly from a heavy hydrocarbon feed, such as a crude oil, without the need of a refinery-type operation.

EXAMPLE

FIG. 1 illustrates a steam cracking process in an olefin plant according to this invention. A crude oil known as Arab Light crude is fed via line 1 to preheat zone A of the convection section of pyrolysis furnace 101 at a rate of 87,000 lb/h at ambient temperature and pressure. The Arab Light crude contains about 20 wt % of hydrocarbons that boil at a temperature greater than 1,050° F. (565° C.), including asphaltenes and tars. In the convection section, the feed is heated to about 740° F. (393° C.) at about 60 psig, and then passed via line 2 into the upper zone 11 of vaporization unit 102. In zone 11, a mixture of gasoline and naphtha vapors are formed at about 350° F. (177° C.) and 60 psig, which is separated from the remaining liquid. The separated vapors are removed from zone 11 via line 4.

The hydrocarbon liquid remaining in zone 11 is transferred to lower zone 12 via line 3 and fall downwardly in zone 12 toward the bottom of unit 102. Preheated steam at about 1,020° F. (549° C.) is introduced to the bottom portion of zone 12 at a rate of 30,000 lb/h via line 13 to give a steam-to-hydrocarbon weight ratio of about 0.6:1 in section 12. The falling hydrocarbon liquid droplets in zone 12 are contacted with the rising steam through packing bed 10.

A gaseous mixture of steam and hydrocarbons at about 800° F. (426° C.) is withdrawn from near the top of zone 12 via line 5 and mixed with the vapors removed from zone 11 via line 4 to form a combined steam-hydrocarbon vapor mixture in line 7. The mixture in line 7 has a steam-to-hydrocarbon weight ratio of about 0.5:1. This mixture is preheated in zone C, and introduced into zone D of the radiant section at a total hydrocarbon flow rate of 69,000 lb/h for thermal cracking at a temperature in the range of 1,450 to 1,550° F. (788 to 843° C.). The cracked products are removed by way of line 14 for down-stream processing in the recovery section (not shown in FIG. 1) of the olefin plant.

The residual oil from zone 12 is removed from unit 102 at a rate of 18,000 lb/h at a temperature of about 600° F. (315° C.) and a pressure of about 70 psig via line 8, heated to 750° F. (399° C.), and passed to a FCC unit 103, which is operated at a temperature of about 1130° F. (610° C.) and a pressure of about 12 psig.

The cracked product is fed to the FCC main fractionator, column 104 to produce an overhead stream in line 16, a light cycle oil in line 17, and a heavy cycle oil in line 18. The overhead stream is sent to the recovery section (not shown in FIG. 1) of the olefin plant for further processing. The light cycle oil is hydrotreated with hydrogen in zone 105 in the presence of a Ni—Mo catalyst. The hydrotreating is reaction is carried out at a temperature of about 500 to 600° F., a pressure of about 2000 psig, and a weight hourly space velocity of about 2 $h^{-1}$ to form a hydrotreated light cycle oil. The hydrotreated light cycle oil is combined with the overhead stream in line 16 and the feed in line 1.

I claim:

1. A process for cracking a heavy hydrocarbon feed in a steam cracker having a convection section and a radiant section, the process comprising:

(a) passing the heavy hydrocarbon feed to a first zone of a vaporization unit and separating the feed into a first vapor stream and a first liquid stream in the first zone;

(b) passing the first liquid stream to a second zone of the vaporization unit and contacting the first liquid stream with counter-current steam in the second zone of the vaporization unit so that the first liquid stream intimately mixes with the steam to produce a second vapor stream and a second liquid stream;

(c) steam-cracking the first vapor stream and the second vapor stream in the radiant section of the steam cracker to produce a cracked effluent;

(d) cracking the second liquid stream in the presence of a cracking catalyst to produce a cracked product (catalytic cracking step);

(e) distilling the cracked product to an overhead stream, a light cycle oil, and a heavy cycle oil;

(f) hydrotreating the light cycle oil to produce a hydrotreated light cycle oil; and (g) passing the hydrotreated light cycle oil to the vaporization unit.

2. The process of claim 1 wherein the light cycle oil has a boiling range of from about 204 to about 343° C.

3. The process of claim 1 wherein the heavy hydrocarbon feed is heated to 177 to 399° C. in the convection section of the steam cracker before it enters the first zone of the vaporization unit.

4. The process of claim 1 wherein the first zone of the vaporization unit is at a temperature of from 177 to 399° C. and a pressure of 15 to 100 psig.

5. The process of claim 1 wherein the counter-current steam is at a temperature of from 482 to 704° C. and a pressure of 15 to 100 psig.

6. The process of claim 1 wherein the second zone of the vaporization unit is at a temperature of from 260 to 482° C. and a pressure of 15 to 100 psig.

7. The method of claim 1 wherein the second zone has at least one liquid distribution device.

8. The method of claim 1 wherein the second zone contains a tower packing material.

9. The process of claim 1 wherein the second liquid stream is catalytically cracked at a temperature of from 454 to 871° C. and a pressure of 5 to 300 psig.

10. The process of claim 1 wherein the catalytic cracking step is performed at a temperature of from 538 to 649° C.

11. The process of claim 1 wherein the catalytic cracking step is performed in a fluidized bed.

12. The process of claim 1, further comprising passing the heavy cycle oil to a gasoline fractionator.

* * * * *